US010807159B2

(12) United States Patent
Seung et al.

(10) Patent No.: US 10,807,159 B2
(45) Date of Patent: Oct. 20, 2020

(54) VERTICAL CENTRIFUGAL CASTING DEVICE

(71) Applicant: HANDS CORPORATION LTD., Incheon (KR)

(72) Inventors: Hyeon-Chang Seung, Seoul (KR); Young-Sik Kim, Incheon (KR); Kyoung-Duck Shin, Gimpo-si (KR); Keon-Ki Han, Incheon (KR); In-Bum Hwang, Incheon (KR)

(73) Assignee: HANDS CORPORATION LTD., Incheon (KR)

( * ) Notice: Subject to any disclaimer, the term of this patent is extended or adjusted under 35 U.S.C. 154(b) by 122 days.

(21) Appl. No.: 16/085,030

(22) PCT Filed: Sep. 7, 2016

(86) PCT No.: PCT/KR2016/010016

§ 371 (c)(1),
(2) Date: Sep. 14, 2018

(87) PCT Pub. No.: WO2018/016676

PCT Pub. Date: Jan. 25, 2018

(65) Prior Publication Data

US 2020/0290116 A1 Sep. 17, 2020

(30) Foreign Application Priority Data

Jul. 20, 2016 (KR) ..... 10-2016-0091731

(51) Int. Cl.
*B22D 13/02* (2006.01)
*B22D 13/10* (2006.01)

(52) U.S. Cl.
CPC ..... *B22D 13/026* (2013.01); *B22D 13/101* (2013.01)

(58) Field of Classification Search
CPC ..... B22D 13/02; B22D 13/026; B22D 13/10; B22D 13/101; B22D 13/12
See application file for complete search history.

(56) References Cited

U.S. PATENT DOCUMENTS

2017/0072459 A1* 3/2017 Lee ..... B22D 13/10

FOREIGN PATENT DOCUMENTS

| | | |
|---|---|---|
| JP | 2008-272812 | 11/2008 |
| KR | 20-0357208 | 7/2004 |
| KR | 10-2005-0029894 | 3/2005 |
| KR | 10-2006-0013722 | 2/2006 |
| KR | 10-0738998 | 7/2007 |

* cited by examiner

*Primary Examiner* — Kevin E Yoon
(74) *Attorney, Agent, or Firm* — Lex IP Meister, PLLC

(57) ABSTRACT

The present invention relates to a vertical centrifugal casting device comprising: an installation frame including a rotary table; a rotation table bearing-coupled to the rotary table so as to be rotated by the operation of a driving means; a supply connection means; rotation-preventing equipment; a mold part; a side mold fixing means; an upper mold fixing means; a connection fixing part; a lifting means; and an ejector means coupled to the lifting frame of the lifting means so as to eject a molded product.

5 Claims, 6 Drawing Sheets

VERTICAL CENTRIFUGAL CASTING DEVICE

TECHNICAL FIELD

The present invention relates to a vertical centrifugal casting device. More particularly, the present invention relates to a vertical centrifugal casting device that enables easy and safe centrifugal casting by enabling a mold unit to be placed at an accurate position, enabling a manufactured product to be easily separated, and preventing separation of the mold unit, that enables a molded product to be easily taken out by separating/combining a lifting frame and a fixed plate using cope clamp-up; that enables a used mold to be separated to be checked and maintained; and that can prevent damage and breakdown due to twisting of a hose connected to a cooling pipe of the mold part by stably fixing the hose.

BACKGROUND ART

In general, it is difficult to manufacture ring-shaped metallic products, particularly, ring-shaped metallic products having specific shapes such as a curved portion through forging wherein ingot that is an intermediate product is heated and then pressed with a press. Accordingly, such ring-shaped metallic products have been manufactured by sand casting wherein products are manufactured by pouring molten metal obtained by heating metal into a sand mold having a predetermined shape therein, cooling the molten metal, and then performing heat treatment thereon.

However, a wooden pattern, a core, etc. are required to manufacture a sand mold and a foundry is required for sand casting, so the manufacturing process is complicated. Further, many parts such as a sprue or a riser of a metal mold manufactured by a sand mold should be unnecessarily removed, so it takes long time and much cost to manufacture ring-shaped metallic products in sand casting, and accordingly, the efficiency of manufacturing products is reduced.

Accordingly, vertical centrifugal casting that does not require separate manufacture and preparation of a wooden pattern, a core, etc., can reduce a foundry process, and has high efficiency of manufacturing ring-shaped metallic products by pouring molten metal into a ring-shaped metal mold rotated by a driving unit and making the shapes of ring-shaped metallic products using centrifugal force that is generated by rotation.

Such vertical centrifugal casting has been disclosed in Korean Patent Application Publication No. 10-2005-0029894.

DISCLOSURE

Technical Problem

However, a centrifugal casting device for manufacturing automotive wheels in the related art is incomplete in structure and the organic combination structure is not known, so the device cannot be actually applied.

Technical Solution

An object of the present invention is to provide a vertical centrifugal casting device that can easily perform centrifugal casting through a mold part by controlling rotation and anti-rotation of a rotating table using an anti-rotation part and that can enable the mold unit to be placed at an accurate position and a manufactured product to be easily separated.

Another object of the present invention is to provide a vertical centrifugal casting device that can enable easily assembly a mold unit and separation of a molded product because side molds sliding-coupled to a cope and guides are operated when the cope is moved up and down, that can prevent opening of the mold unit using a side mold fixing unit and a cope fixing unit, and that can be conveniently and safely used by preventing molten metal poured in the mold unit from flying out of the mold.

Another object of the present invention is to provide a vertical centrifugal casting device that can easily take out a molded product by controlling whether to lift a connection-fixing unit and the cope when operating a lifting cylinder because a lifting cylinder can be coupled to and separated from a fixing plate of the connection-fixing unit using a cope clamp-up, and that enables a used mold to be easily checked and maintained.

Another object of the present invention is to provide a vertical centrifugal casting device that can safely manufacture a product through centrifugal casting by preventing a hose from being twisted by up-down movement of a mold unit by stably fixing the hose connected to a cooling pipe of the mold unit through a cable chain and a chain bracket disposed at a side of the mold unit.

In order to achieve the object of the present invention, a vertical centrifugal casting device includes: an installation frame having a rotary table; a rotating table combined with the rotary table through a bearing and rotated by a driving unit; a supply connection unit including a rotary member combined with the rotating table and supplying cooling air and a slip ring combined with the rotary table in a cylindrical shape close to the outer side of the rotary member to connect power; an anti-rotating unit preventing rotation of the rotating table by separating and combining the rotary table and the rotating table; a mold unit including a drag coupled to the upper portion of the rotating table through a fixed frame, a plurality of guiders each having inclined protrusions on both sides and fixed on the drag with regular intervals, a cope disposed over the drag, and a plurality of side molds having upper portions sliding-coupled to the lower portion of the cope and having both sides sliding-coupled to the inclined protrusions of the guiders: a side mold fixing unit including a locking post having a coupling protrusion protruding downward and configured in the core of the mold unit and a first coupling groove formed on the drag of the mold unit to be coupled and separated to and from the coupling protrusion of the locking post; a core fixing unit including a second coupling groove formed at the locking post of the side mold fixing unit and a locking member disposed on the fixed frame to be coupled and separated to and from the second coupling groove; a connection-fixing unit including a connection bar coupled to the cope of the mold unit and a fixed plate coupled to the connection bar over the cope; a lifting unit including a lifting frame having a cope clamp-up disposed over the cope of the mold unit to be coupled and separated to and from the fixed plate of the connection-fixing unit, lifting cylinders coupled to the installation frame to lift the lifting frame, and lifting guiders disposed between the installation frame and the lifting frame to guide lifting of the lifting frame; and an ejector unit combined with the lifting frame of the lifting unit to eject a molded product.

Advantageous Effects

According to the vertical centrifugal casting device of the present invention, since it is possible to control rotation and anti-rotation of the rotating table through the anti-rotating unit, it is possible to easily perform centrifugal casting by rotation of the mold unit, to place the mold unit at an accurate position, and to easily separate a manufactured product.

Further, according to the present invention, it is possible to easily assemble a mold unit and separate a molded product because side molds sliding-coupled to a cope and guides are operated when the cope is moved up and down, to prevent opening of the mold unit using a side mold fixing unit and a cope fixing unit, and to conveniently and safely use the centrifugal casting device by preventing molten metal poured in the mold unit from flying out of the mold.

Further, according to the present invention, it is possible to easily take out a molded product by controlling whether to lift a connection-fixing unit and the cope when operating a lifting cylinder because a lifting cylinder can be coupled to and separated from a fixing plate of the connection-fixing unit using a cope clamp-up, and it is also possible to enable a used mold to be easily checked and maintained.

Further, according to the present invention, since the hose connected to the cooling pipe of the mold unit can be stably fixed by a cable chain and a chain bracket disposed at a side of the mold unit, it is possible to safely manufacture a product through centrifugal casting by preventing the hose from being twisted by up-down movement of the mold unit.

DESCRIPTION OF REFERENCE NUMERALS

10: Installation frame 11: Rotary table

Figure 1:
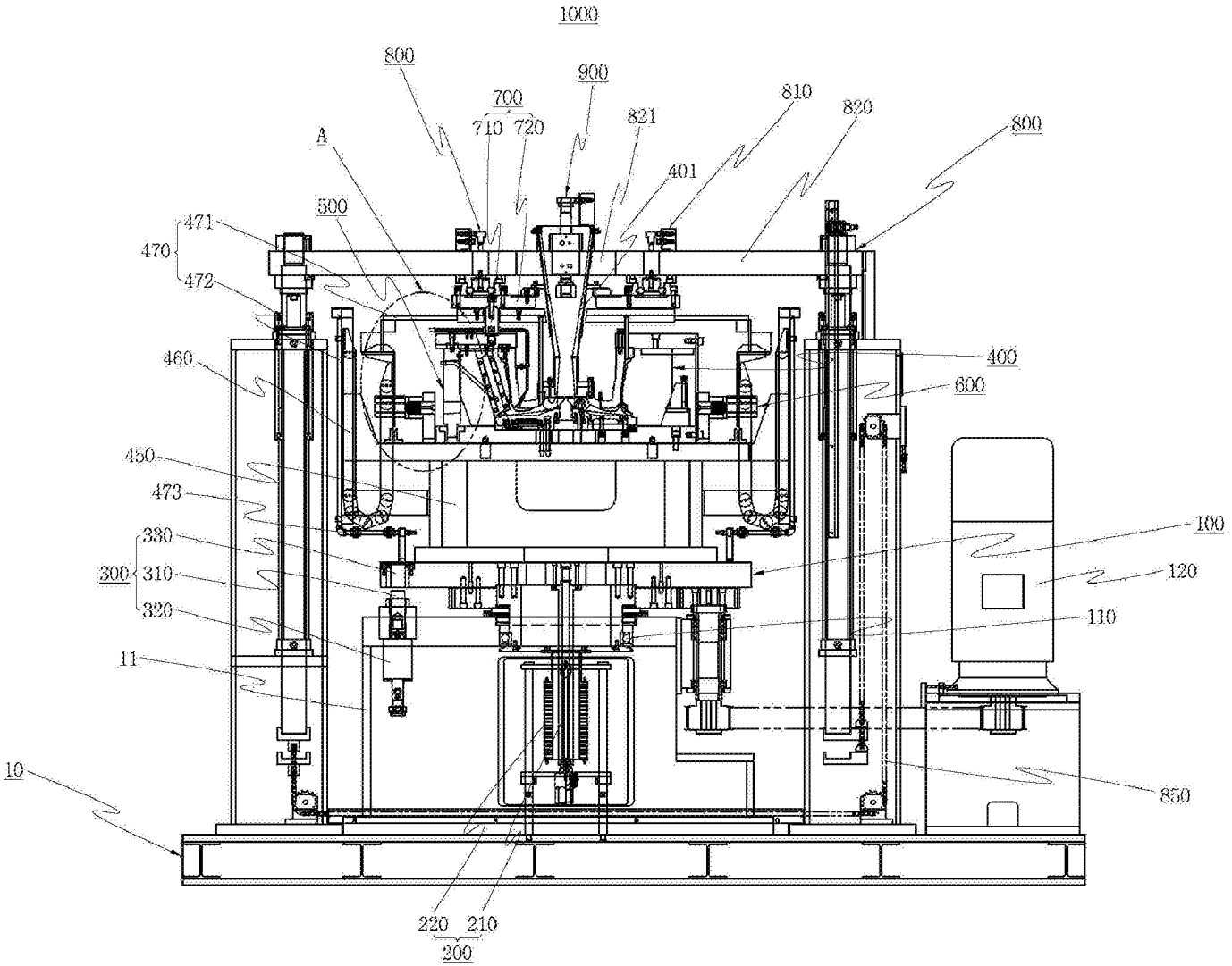
FIG. 1 is a schematic front view of a vertical centrifugal casting device of the present invention.

100: Rotating table 110: Bearing 120: Driving unit

200: Supply connection unit 210: Rotary member 220: Slip ring

300: Anti-rotation unit 310: Fixing rod 320: Fixing cylinder 330: Fixing groove

400: Mold unit 401: Hopper 403: Cooling pipe 410: Drag 411: First guide groove 412: First guide protrusion 413: Second guide protrusion 420: Guider 421: Inclined protrusion 430: Cope 431: Second guide groove 432: Third guide protrusion 433: Fourth guide protrusion 434: Guide protrusion 440: Side mold 450: Fixing frame 460: Cable chain 470: Chain bracket 471, 472: First, second bracket 473: Connector 480: Unloader

500: Side mold fixing unit 510: Locking post 520: First coupling groove

600: Cope fixing unit 610: Second coupling groove 620: Locking member

700: Connection-fixing unit 710: Connecting bar 720: Fixing plate

800: Lifting unit 810: Cope clamp-up 811: Clamp groove 812: Clamp 813: Insertion hole 814: Guide 815: Fixer 816: Guide fixing portion 817: Clamp rod 818: Clamp cylinder 819: Coupling ball 820: Lifting frame 821: Installation hole 830: Lifting cylinder 840: Lifting guider 850: Chain

900: Ejector unit 910: Ejector cylinder 911: Ejector rod 920: Through-hole 930: Ejector 931: Ejector plate 933: Ejector pin 940: Return member

1000: Vertical centrifugal casting device

BEST MODE

Figure 2:
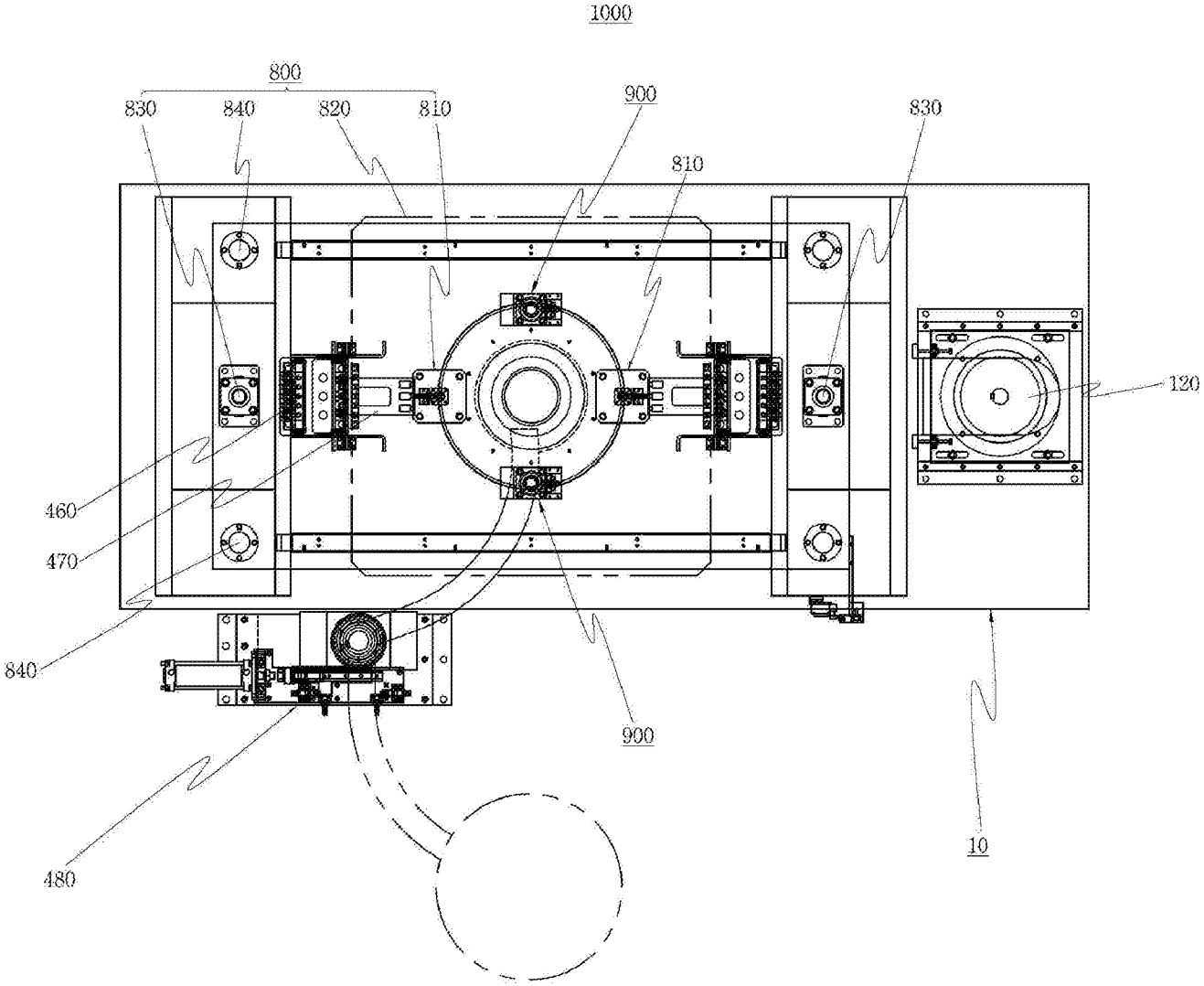
FIG. 2 is a schematic plane view of the vertical centrifugal casting device of the present invention.
Figure 3:
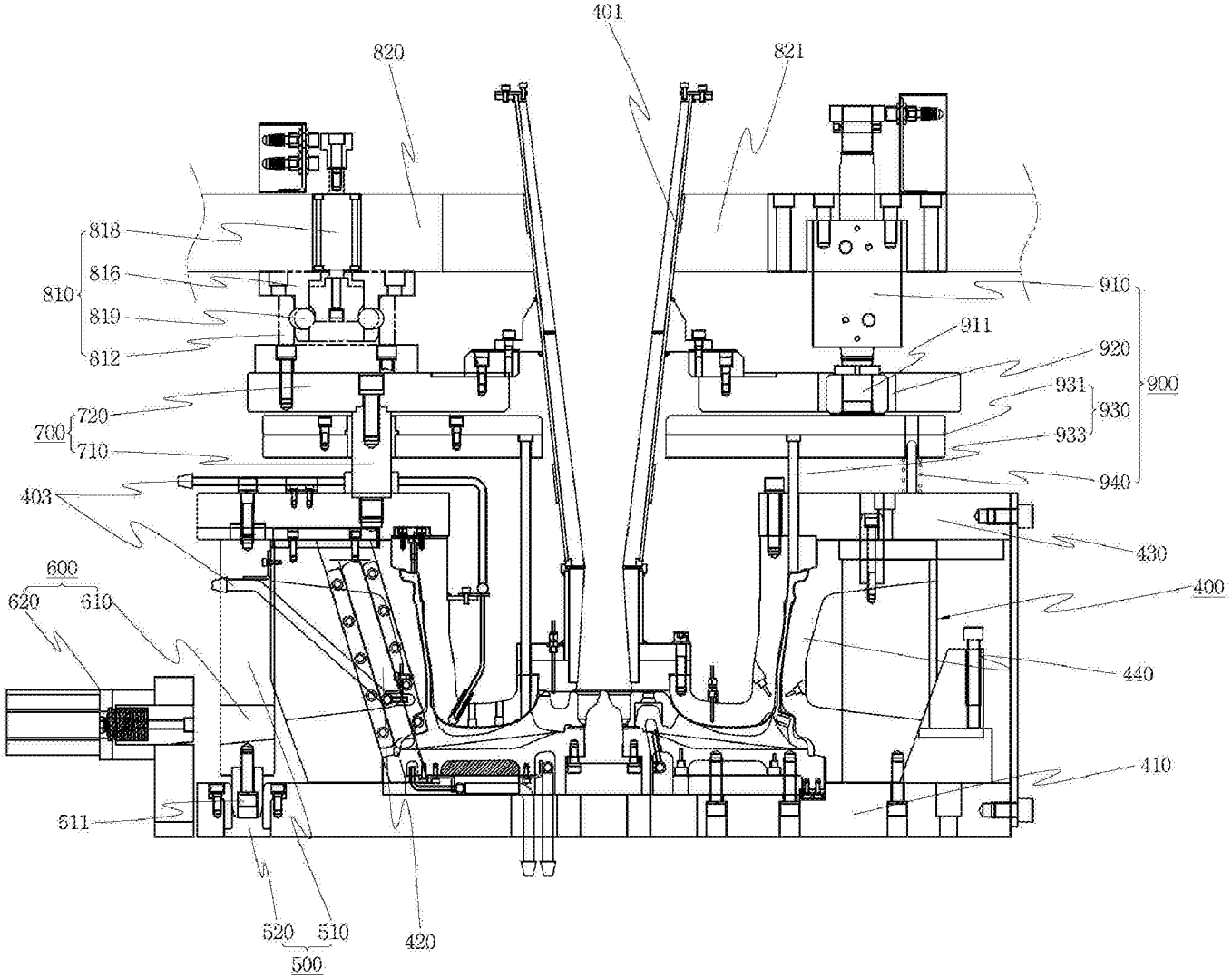
FIG. 3 is a schematic view showing an assembled state of a mold unit, a side mold fixing unit, a cope fixing unit, a connection-fixing unit, a lifting unit, and an ejector unit of the present invention.
Figure 4:
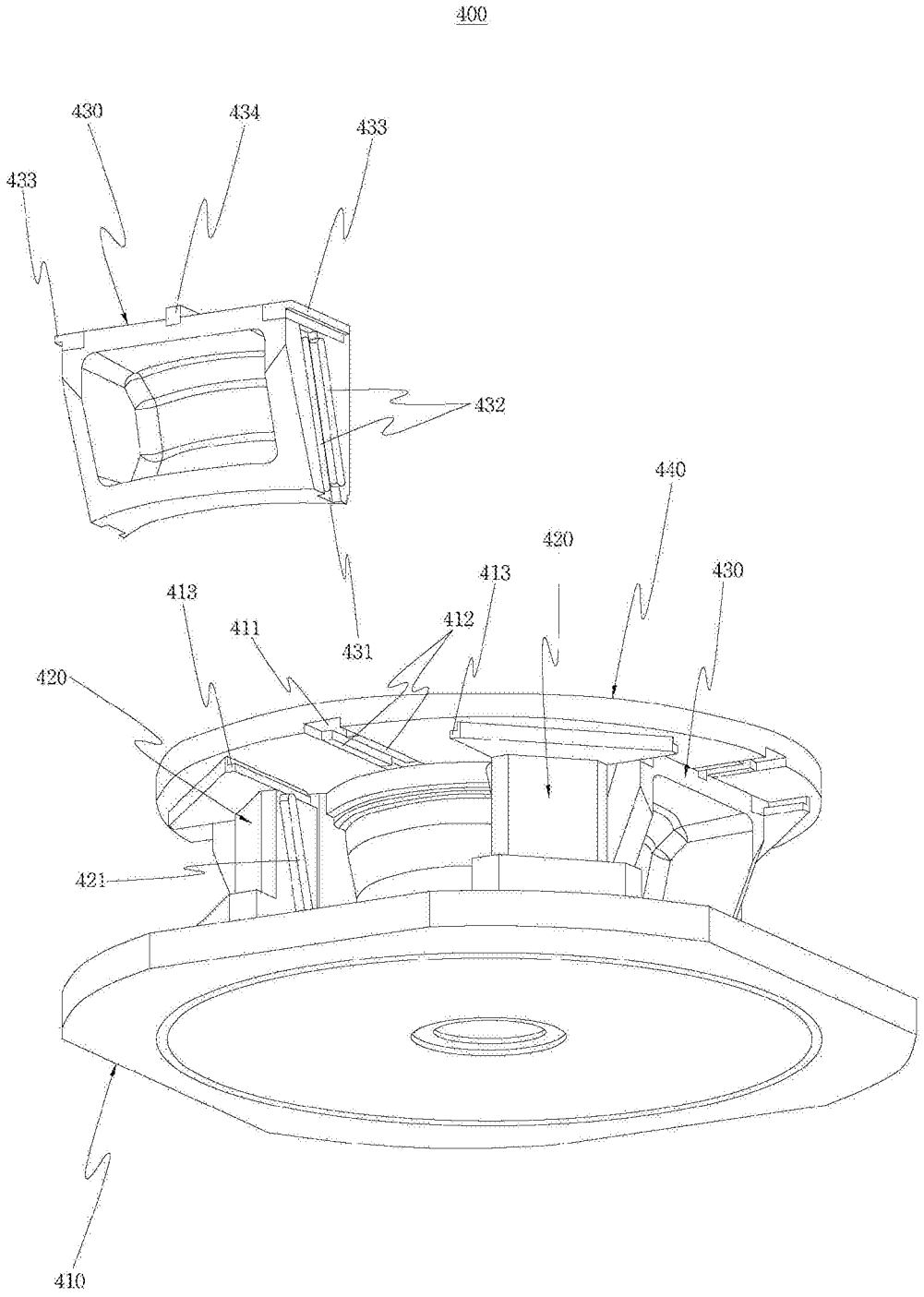
FIG. 4 is a partial exploded perspective view of the mold unit of the present invention.
Figure 5:
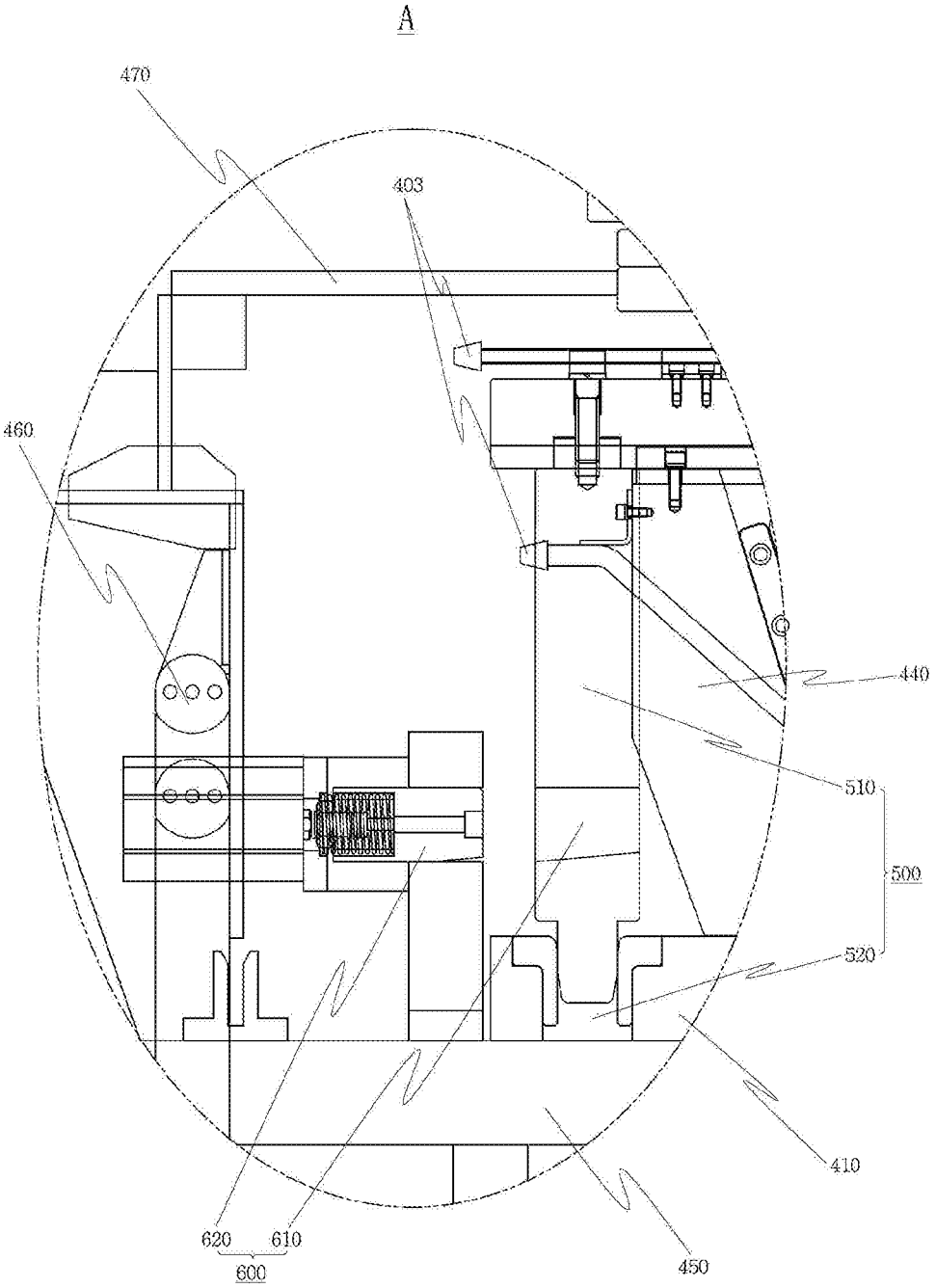
FIG. 5 is an enlarged view of the portion A of FIG. 1 of the present invention.
Figure 6:
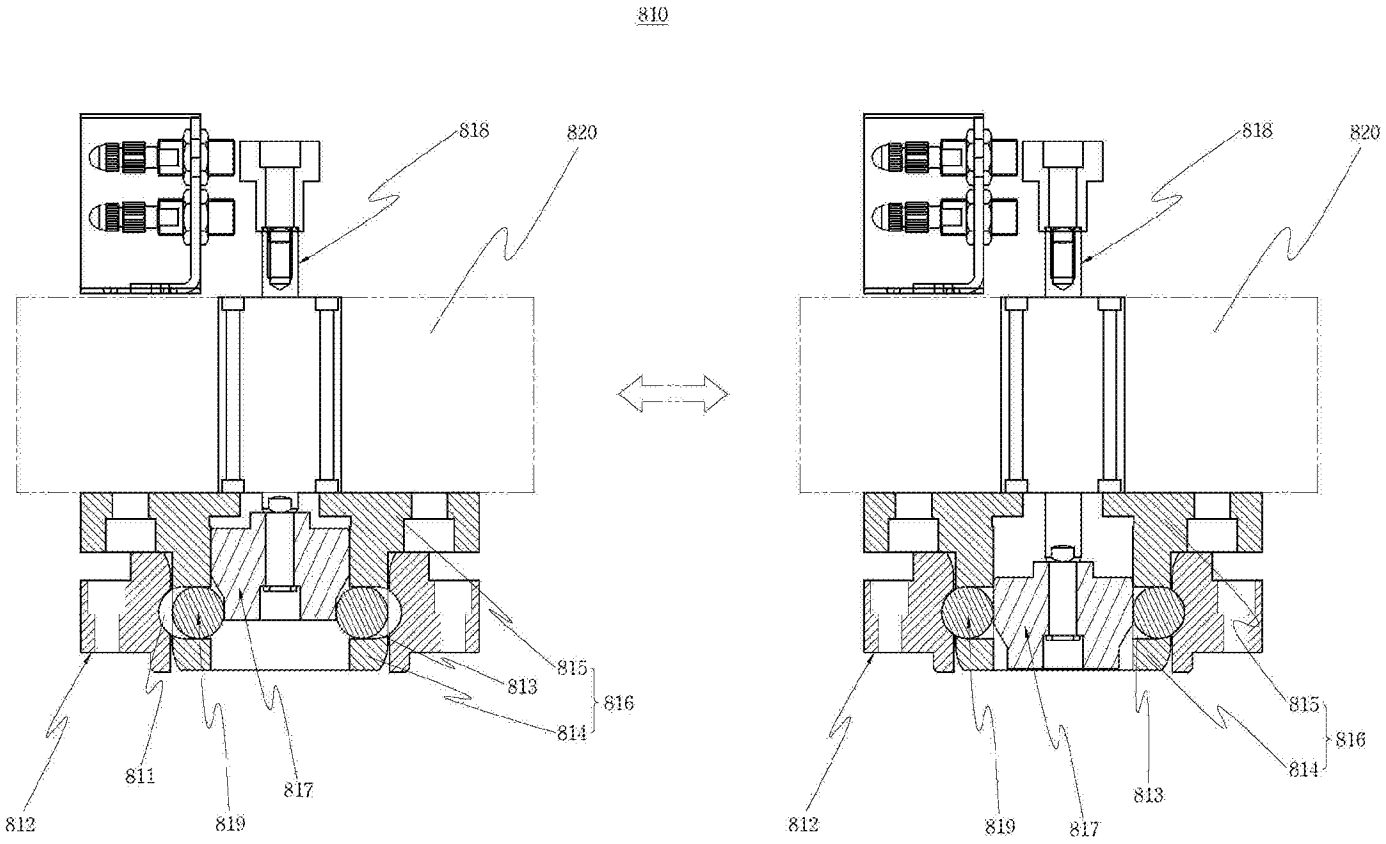
FIG. 6 is a view showing the states before and after a cope clamp-up of the present invention is operated.

The present invention relates to a vertical centrifugal casting device 1000 for molding products such as a wheel, as shown in FIGS. 1 to 6. The vertical centrifugal casting device 1000 includes: an installation frame 10 having a rotary table 11; a rotating table 100 combined with the rotary table 11 through a bearing 110 and rotated by a driving unit 120; a supply connection unit 200 including a rotary member 210 combined with the rotating table 110 and supplying cooling air and a slip ring 220 combined with the rotary table 11 in a cylindrical shape close to the outer side of the rotary member 210 to connect power; an anti-rotating unit 300 preventing rotation of the rotating table 100 by separating and combining the rotary table 11 and the rotating table 100; a mold unit 400 including a drag 410 coupled to the upper portion of the rotating table 100 through a fixed frame, a plurality of guiders 420 each having inclined protrusions 421 on both sides and fixed on the drag 410 with regular intervals, a cope 430 disposed over the drag 410, and a plurality of side molds 440 having upper portions sliding-coupled to the lower portion of the cope 430 and having both sides sliding-coupled to the inclined protrusions 421 of the guiders 420: a side mold fixing unit 500 including a locking post 510 having a coupling protrusion 511 protruding downward and configured in the core 430 of the mold unit 400 and a first coupling groove 520 formed on the drag 410 of the mold unit 400 to be coupled and separated to and from the coupling protrusion 511 of the locking post 510; a core fixing unit 600 including a second coupling groove 610 formed at the locking post 510 of the side mold fixing unit 500 and a locking member 620 disposed on the fixed frame to be coupled and separated to and from the second coupling groove 610; a connection-fixing unit 700 including a connection bar 710 coupled to the cope 430 of the mold unit 400 and a fixed plate 720 coupled to the connection bar 710 over the cope 430; a lifting unit 800 including a lifting frame 820 having a cope clamp-up 810 disposed over the cope 430 of the mold unit 400 to be coupled and separated to and from the fixed plate 720 of the connection-fixing unit 700, lifting cylinders 830 coupled to the installation frame 10 to lift the lifting frame 820, and lifting guiders 840 disposed between the installation frame 10 and the lifting frame 820 to guide lifting of the lifting frame 820; and an ejector unit 900 combined with the lifting frame 820 of the lifting unit 800 to eject a molded product. The vertical centrifugal casting device will be described in detail hereafter.

First, the installation frame 10, which is a fundamental frame for installing the vertical centrifugal casting device of the present invention, includes the rotary table 11 for rotatably supporting the rotating table 100 and connecting the supply connection unit 200.

Second, the rotating table 100, which is a part combined with the rotary table 11 through the bearing 110 to be rotated by the driving unit 120, is coupled to the center of the rotary table by a bearing to rotate the mold unit supplied with molten metal.

The driving unit 120, which is a part for transmitting torque to the rotating table 100, transmits power from a driving motor using a belt pulley and engagement of gears connected to the belt pulley, but other common methods may be used.

Third, the supply connection unit 200, which is a part that supplies cooling air into the mold unit operated by the rotating table 100 rotated by the driving unit 120, is composed of the rotary member 210 combined with the rotating table 100 to supply cooling air and the slip ring 220 combined with the rotary table 11 in a cylindrical shape close to the outer side of the rotary member 210.

Here, the slip ring 220 is connected with the rotary member 210 in a non-contact type to supply electricity and the structure of the slip ring 220 for non-contact electrical connection is well known in the art, so it is not described in detail herein.

Fourth, the anti-rotating unit 300, which is a part that allows for or prevents rotation of the rotating table 100 by coupling and separating the rotary table 11 and the rotating table 100, is used when the rotating table 100 is required to be stopped.

That is, the mold unit 400 should be aligned at an accurate position when the mold unit 400 is placed on the vertical centrifugal casting device 100 of the present invention or a molded product is separated, so the anti-rotating unit 300 is used in this case.

Further, the anti-rotating unit 300 is composed of a fixing cylinder 320 fixed to the rotary table 11 and a fixing groove 330 formed in the rotating table 100. A fixing rod 310 that moves up and down is disposed on the fixing cylinder 320 at a position corresponding to the fixing groove 330 of the rotating table 100 to that when the fixing cylinder 320 is operated, the anti-rotating unit 300 is coupled and separated, in which two or more anti-fixing units 330 may be provided to stably fix the rotating table 100.

Fifth, the mold unit 400, which is a part for manufacturing products such as a wheel, is composed of the drag 410 coupled to the upper portion of the rotating table 100 through the fixed frame, a plurality of guiders 420 each having inclined protrusions 421 on both sides and fixed on the drag 410 with regular intervals, cope 430 disposed over the drag 410, and a plurality of side molds 440 disposed each between the guiders 420. Four guiders and four side molds 440 may be provided with regular intervals for easy assembly and disassembly of the mold unit 400.

Further, the mold unit 400 includes a common hopper 401 integrally connected to the cope by welding etc., and a common cooling pipe 403 for cooling products to be molded.

The side molds 440 are sliding-coupled to the lower portion of the cope 430 at the upper portion and sliding-coupled to the inclined protrusions 421 of the guides at both sides to be able to operate with up-down movement of the cope. The inclined protrusions 421 may be formed to open outward as they go upward to easily take out molded products.

Therefore, according to this structure, when the cope 430 is moved up, the side molds 440 open outward, so a product can be easily taken out of the mold unit 400.

The cope 430 and the side molds 440 and the side molds 440 and the guiders 420 can be easily sliding-coupled by forming slide coupling portions corresponding to one another on the cope 430, the side molds 330, and the guiders 420. In the present invention, the cope 430 and the side molds 440 can be easily sliding-coupled by forming a pair of first guide protrusions 412 on the bottom of the cope 430, forming a groove between the first guide protrusions 412, and forming a guide protrusion 434 corresponding to the groove at the upper portion of the side molds 440. Further, first guide grooves 411 in which the pair of first guide protrusion 412 are inserted may be further formed on the bottom of the cope 430 such that the tops of the side molds 440 are disposed close to the bottom of the cope 430.

Further, slide coupling of the cope 430 and the side molds 440 can be achieved by, other than the configuration described above, forming fourth guide protrusions 433 at the upper portions of both sides of the side molds 440 and forming second guide protrusions 413 to form groves corresponding to the fourth guide protrusions 433 on the bottom of the cope. Both of these configurations may be applied for more stable sliding of the side molds 440.

Further, slide coupling of the side molds 440 and the guiders 420 can be achieved by forming a pair of third guide protrusions 432 on both sides of the side molds 440 such that grooves corresponding to the inclined protrusions 421 on both sides of the guiders 420 are formed on both sides of the side molds 440. Second guide grooves 431 in which the pair of third guide protrusions 432 are inserted may be further formed on both sides of the side molds 440 such that the guides and both sides of the side molds are disposed close to each other.

Therefore, according to this configuration, when the cope 430 is moved up, the side molds 440 are moved up and opened outward, so the mold unit 400 is separated. Further, when the cope 430 is moved down, the side molds 440 are moved down and closed inward, so the mold unit 400 is assembled.

Sixth, the side mold fixing unit 500, which is a part that maintain roundness by preventing the assembled mold unit 400 from opening outward during centrifugal casting, is composed of the locking post 510 having a coupling protrusion 511 protruding downward and configured in the core 430 of the mold unit 400 and the first coupling groove 520 formed on the drag 410 of the mold unit 400 to be coupled and separated to and from the coupling protrusion 511 of the locking post 510.

The first coupling groove 520 may be formed through the drag, but a common bush may be provided to protect the drag 410 from wear and damage.

Seventh, the core fixing unit 600, which is a part that prevents the cope of the assembled mold from being lifted during centrifugal casting, is composed of the second coupling groove 610 formed at the locking post 510 of the side mold fixing unit 500 and locking member 620 disposed on the fixed frame to be coupled and separated to and from the second coupling groove 610. The locking member 620 may be a piston rod that moves forward and backward with the operation of a common cylinder.

For firm fixing that uses the locking member 620, a compression spring that additionally applies a pressing force to the piston rod may be further included. The second coupling groove 610 may be formed in a wedge shape such that the piston rod of the locking member 620 is forcibly fitted therein, whereby fixing by the locking member 620 can be more firmly established.

Accordingly, the side molds 440 are not opened or the cope 430 is not lifted, that is, the mold unit 400 is not separated during centrifugal casting by the side mold fixing unit 500 and the cope fixing unit 600, so a safety accident that the molten metal in the mold unit 400 is prevented from flying out of the mold. Accordingly, products such as a wheel can be safely manufactured by centrifugal casting.

Eighth, the connection-fixing unit 700, which is a part for stably fixing the hopper 401 on the mold unit 400 and helping the mold unit 400 be safely lifted, is composed of the plurality of connection bars 710 coupled to the cope 430 of the mold unit 400 and the fixed plate 720 coupled to the connection bar 710 over the cope 430.

Ninth, the lifting unit 800, which is one of parts that enables a manufactured product to be easily separated from the mold unit 400 by disassembling the mold unit 400 or lifting the cope 430, is composed of the lifting frame 820 having a cope clamp-up 810 disposed over the cope 430 of the mold unit 400 to be coupled and separated to and from the fixed plate 720 of the connection-fixing unit 700, and the lifting cylinders 830 coupled to the installation frame 10 to lift the lifting frame 820.

The lifting unit 800 further includes the plurality of lifting guiders 840 disposed between the installation frame 10 and the lifting frame 820 to guide lifting of the lifting frame 820. The lifting guiders 840 at a side and the other side are connected to each other by a chain 850 such that even though the lifting cylinders 830 at both sides are separately operated, the lifting guiders 840 at both sides are operated together to uniform lifting. Accordingly, safety of the present invention can be further increased.

Further, the cope clamp-up 810 of the lifting unit 800, which is a part for coupling and separating the lifting unit 800 to and from the fixing plate 720 of the connecting-fixing unit 700, as described above, may have various configurations well known in the art. However, in the present invention, the cope clamp-up 810 is composed of a guide fixing portion 816, a clamp cylinder 818, and a coupling ball 819, which will be described in detail below.

First, a clamp 812, which is a part bolted in a common type to a fixing clamp 720 connected to the cope 430 of the mold unit 400 to lift the mold unit 400, is formed in a cylindrical shape and has a plurality of clamp grooves 811 on the inner side.

The guide fixing portion 816, which is a part bolted in a common type to the lifting frame of the lifting unit 800 for lifting the mold unit 400, is composed of a fixer 815 fixed to the lifting frame 820 and a cylindrical guide 814 integrally formed at the lower portion of the fixer 815 and fitted inside the clamp 812. An insertion hole 813 corresponding to the clamp groove 811 of the clamp 812 is formed through the guide 814.

The clamp cylinder 818, which is a part fixed to the lifting frame 820 by common bolting to lift the clamp rod 817, pushes outward the coupling ball 819 fitted in the insertion hole 813 when moving down. To this end, the clamp rod 817 is tapered downward and disposed inside the guide 814.

The coupling ball 819, as described above, is fitted in the insertion groove 813 of the guide-fixing portion 816 and is coupled and separated to and from the clamp groove 811 of the clamp 82 when the clamp rod 817 is moved up and down.

Tenth, the ejector unit 900, which is a part combined with the lifting frame 820 of the lifting unit 800 to take out a molded product, is composed of an ejector cylinder 910 constituting an ejector rod 911 and fixed to the lifting frame 820 and a through-hole 920 formed in the fixing plate 20 to insert the ejector rod 911 therein.

The ejector unit 900 further includes an ejector 930 composed of an ejector plate 931 disposed between the cope 430 of the mold unit 400 and the fixing plate 720 and an ejector pin 933 combined with the ejector plate 931 to separate a product molded by the mold unit 400 from the cope 630. Further, a return member 940 is disposed between the cope 430 of the mold unit 400 and the ejector plate 931 to return the ejector 930 that has been moved down by the ejector cylinder 910 to the initial state.

Further, a through-hole through which the ejector pin 933 passes should be formed at the cope 430 to correspond to the ejector pin 933 such that a product attached to the cope 430 can be separated from the cope 430 by the ejector pin 933.

Further, the return member 940 may be composed of a plurality of common springs disposed between the cope 430 and the ejector plate 931, and in this case, fitting protrusions may be further formed at the cope so that the springs can be fitted thereon to easy installation and prevention of separation of the springs. When the fitting protrusions are formed, as described above, fitting grooves corresponding to the fitting protrusions should be further formed at the ejector plate 931 so that the ejector plate 931 can be operated by the ejector cylinder 910.

A common well-known hose (not shown) for supplying and circulating common cooling air is connected to the cooling pipe 403 of the mold unit 300 to be operated when the cope 430 is lifted and the mold unit 400 is rotated, so there is danger of safety accident due to twisting and shaking of the hose. However, the present invention further includes a unit for fixing the hose to a side of the mold unit, thereby preventing a safety accident.

The hose fixing unit can be easily achieved by further including a chain bracket 470 to which a cable chain 460 for fixing the hose to a side of the mold unit 400 is coupled. The chain bracket 470 is composed of a first bracket 471 connected to a side of the cable chain 460 and a second bracket 472 connected to the other side of the cable chain 460 and connected to the rotating plate 100 through a common connector 473. The first bracket 471 may be coupled to any one of the cope 430 of the mold unit 400, the fixing plate 720 of the connection-fixing unit 700, and the ejector plate 931 of the ejector unit 900.

Further, the cable chain 460 is composed of a plurality of chains connected to each other, so it is moved while smoothly folding even though it is moved up. According to this configuration, the hose connected to the cooling pipe 403 is fixed to the cable chain 460 by a common clamp (not shown) etc., so the hose is not twisted even though it is lifted by the lifting unit 800, so a safety accident due to the hose is prevented during centrifugal casting.

The operation according to the configuration of the present invention described above is as follows.

First, when the cope 430 is moved down and the mold unit 400 installed in the present invention is assembled, the coupling protrusion 511 of the locking post 510 coupled to the cope 430 is fitted into the first coupling groove 520 of the drag 410, so the assembled mold unit 400 does not open outward.

Thereafter, the locking member 620 is operated, so the piston rod of the locking member 620 is fitted into the second coupling groove 610 of the locking post 510 and is coupled to the fixing plate 720 by operating the cope clamp-up 810, and then the lifting frame 820 is lifted by operating the lifting cylinder 830, whereby the mold unit 400 and the connection-fixing unit 700 can be rotated.

In this state, when the driving unit 120 is driven, the rotating table 100 is operated, and the mold unit 400, the connection-fixing unit 700, and the ejector plate 831 are rotated, in which the mold unit 400 is rotated without separating by the side mold fixing units 500 and the cope fixing unit 600, so centrifugal casting that uses molten metal supplied to the hopper 401 can be safely performed.

Further, since the hose connected to the cooling pipe 403 of the mold unit 400 is connected to the mold unit 400 and the rotating table 100 and fixed to the cable chain 460 by the chain bracket 470, a safety accident due to the hose during centrifugal casing can also be prevented.

After a product such as a wheel is completed through the centrifugal casting, the product should be taken out by disassembling the mold unit 400 by lifting the cope 430. To this end, the mold unit 400 and the rotating table 100 are prevented from rotating by fitting the fixing rod 310 into the fixing groove 330 of the rotating table 100 by operating the fixing cylinder 320 of the anti-rotating unit 300, whereby the mold unit 400 is placed at the accurate position.

Thereafter, the coupling ball 819 is coupled to the clamp groove 811 by moving down the clamp rod 817 by operating the clamp cylinder 818 of the cope clamp-up 81, whereby the fixing plate 720 of the connection-fixing unit 700 and the lifting fame 820 are coupled, and then the lifting frame 820 is lifted by operating the lifting cylinder 830.

Accordingly, the fixing plate 720 coupled to the lifting frame 820 through the cope clamp-up 810, the cope 430 of the mold unit 400, and the ejector plate 931 are lifted together. Further, as the cope 430 is lifted, the side molds 440 sliding-coupled to the cope 430 and the guiders 420 are lifted while opening outward, whereby the produced manufactured by centrifugal casting is lifted in the state attached to the cope 430.

Thereafter, a support plate for supporting the product is put under the product using a common unloader 480, the product attached to the cope 430 is separated using the ejector unit 900, and then the product separated and placed on the support plate is automatically carried to the next process by the unloader.

In this process, the ejector pin 931 is pushed by the ejector rod 911 moved down by the ejector cylinder 910 and the ejector pin 833 pushes down the product attached to the cope 430, whereby the product is separated by the ejector unit 900. After the product is separated, when the ejector cylinder 910 is operated and the ejector rod 910 is lifted, the ejector plate 931 is returned to the initial state by the ejector cylinder 910.

As described above, products can be easily manufactured through centrifugal casting of the present invention by repeating the processes described above, and it is possible to easily check and maintain the mold unit 400 by lifting the mold unit 400 using the cope clamp-up 810 to separate the mold unit 400.

Although the present invention was described with reference to limited embodiments and the drawings, the present invention is not limited thereto and may be modified in various ways without departing from the spirit of the present invention.

The invention claimed is:

1. A vertical centrifugal casting device comprising:

an installation frame (10) having a rotary table (11);

a rotating table (100) combined with the rotary table (11) through a bearing (110) and rotated by a driving unit (120);

a supply connection unit (200) including a rotary member (210) combined with the rotating table (100) and supplying cooling air and a slip ring (220) combined with the rotary table (11) in a cylindrical shape close to the outer side of the rotary member (210) to connect power;

an anti-rotating unit (300) preventing rotation of the rotating table (100) by separating and combining the rotary table (11) and the rotating table (100);

a mold unit (400) including a drag (410) coupled to an upper portion of the rotating table (100) through a fixed frame, a plurality of guiders (420) each having inclined protrusions (421) on both sides and fixed on the drag (410) with regular intervals, a cope (430) disposed over the drag (410), and a plurality of side molds (440) having upper portions sliding-coupled to a lower portion of the cope (430) and having both sides sliding-coupled to the inclined protrusions (421) of the guiders (420):

a side mold fixing unit (500) including a locking post (510) having a coupling protrusion (511) protruding downward and configured in the cope (430) of the mold unit (400) and a first coupling groove (520) formed on the drag (410) of the mold unit (400) to be coupled and separated to and from the coupling protrusion (511) of the locking post (510);

a core fixing unit (600) including a second coupling groove (610) formed at the locking post (510) of the side mold fixing unit (500) and a locking member (620) disposed on the fixed frame (410) to be coupled and separated to and from the second coupling groove (610);

a connection-fixing unit (700) including a connection bar (710) coupled to the cope (430) of the mold unit (400) and a fixed plate (720) coupled to the connection bar (710) over the cope (430);

a lifting unit (800) including a lifting frame (820) having a cope clamp-up (810 disposed over the cope (430) of the mold unit (400) to be coupled and separated to and from the fixed plate (720) of the connection-fixing unit (700), lifting cylinders (830) coupled to the installation frame (10) to lift the lifting frame (820), and lifting guiders (840) disposed between the installation frame (10) and the lifting frame (820) to guide lifting of the lifting frame (820; and an ejector unit (900) combined with the lifting frame (820) of the lifting unit (800) to eject a molded product.

2. The vertical centrifugal casting device of claim 1, wherein the anti-rotating unit (300) includes a fixing cylinder (320) constituting a fixing rod (310) that is lifted, and fixed to the rotary table (11), and a fixing groove (330) formed in the rotating table (100) to fit the fixing rod (310) of the fixing cylinder (320) therein.

3. The vertical centrifugal casting device of claim 1, wherein a chain bracket (470) to which a cable chain (460) is coupled is further disposed at a side of the mold unit (400).

4. The vertical centrifugal casting device of claim 1, wherein the cope clamp-up (810) of the lifting unit (800) includes:

a clamp (812) having clamp groove (811) on an inner side thereof and coupled to the fixing plate;

a guide fixing portion (818) composed of a cylindrical guide (814) having an insertion hole (813) formed therethrough to correspond to the clamp groove (811) and fitted in the clamp (812), and a fixer (815) integrally formed at an upper portion of the guide (814) and fixed to the lifting frame (820);

a clamp cylinder (818) constituting a clamp rod (817) tapered downward and disposed in the guide (814), and fixed to the lifting frame (820); and a coupling ball (819) disposed to be fitted in the insertion hole (813) of the guide fixing portion (816) and coupled to and separated from the clamp groove (811) of the clamp (812) when the clamp rod (817) is moved up and down.

5. The vertical centrifugal casting device of claim 1, wherein 1, wherein the ejector unit (900) includes:

an ejector cylinder (910) constituting an ejector rod (911) and fixed to the lifting frame (820);

a through-hole (920) formed in the fixing plate (720) to insert the ejector rod (911) therein;

an ejector (930) composed of an ejector plate (931) disposed between the cope (430) of the mold unit (400) and the fixing plate (720), and an ejector pin (933) coupled to the ejector plate (931) and separating a product molded by the mold unit (400) from the cope (630); and a return member (940) disposed between the cope (430) of the mold unit (400) and the ejector plate (931) and returning the ejector (930).

* * * * *